United States Patent [19]

Turk

[11] Patent Number: 4,881,565

[45] Date of Patent: Nov. 21, 1989

[54] SUNSHADE

[76] Inventor: Alan S. Turk, Edgewater, Md.

[21] Appl. No.: 236,207

[22] Filed: Aug. 25, 1988

[51] Int. Cl.[4] ..... E04H 15/00

[52] U.S. Cl. ..... 135/101; 135/87; 135/106; 135/902; 40/617; 40/603

[58] Field of Search ..... 40/603, 606, 617; 135/106, 101, 902, 87; 403/253, 235, 263, 167, 168

[56] References Cited

U.S. PATENT DOCUMENTS

| | | | |
|---|---|---|---|
| 839,501 | 12/1906 | Munro | 40/607 |
| 965,097 | 7/1910 | Fisher | 40/603 |
| 2,190,566 | 2/1940 | Talian | 135/87 |
| 2,315,680 | 4/1943 | Ward | 135/101 |
| 2,554,688 | 5/1951 | Vollweiler | 135/87 |
| 2,631,392 | 3/1953 | Stevenson | 40/607 |
| 2,660,186 | 11/1953 | Marshall | 135/87 |
| 3,297,063 | 1/1967 | McGuire | 403/233 |
| 3,487,842 | 1/1970 | Larkin | 135/87 |
| 3,487,842 | 1/1970 | Larkin | 135/101 |
| 4,103,445 | 8/1978 | Smith | 40/603 |

FOREIGN PATENT DOCUMENTS

| | | | |
|---|---|---|---|
| 234126 | 6/1961 | Australia | 135/902 |
| 1349339 | 12/1963 | France | 135/101 |
| 654536 | 6/1963 | Italy | 135/902 |

*Primary Examiner*—Henry E. Raduazo

*Attorney, Agent, or Firm*—Scrivener and Clarke

[57] ABSTRACT

A sunshade is provided by a pair of rigid upright support members and a cross member connected to their upper ends and from which hangs by one edge a panel of flexible material. When the lower ends of the support members are pushed into the ground along a line perpendicular to the direction from which the wind blows, the panel is blown by the wind to a substantially horizontal position to provide a shaded area of a size to protect the face of a sun bather lying prone on the ground.

5 Claims, 1 Drawing Sheet

SUNSHADE

This invention relates to sunshades and more particularly to a sunshade especially adapted to shading the face of a sun bather lying in a prone position.

Sunshades, particularly those for use at the beach, usually comprise beach umbrellas which are quite satisfactory for shading a relatively large area but quite unsatisfactory for shading a small portion of the body, say, only the face, while a sun bather lies prone on the beach. Thus there is a need for a face shade for individuals lying on the beach who wish to expose their torsos to the sun but not their faces. Almost always a breeze blows at the beach and I have discovered, in accordance with the invention, that when a panel of fabric or other flexible material is supported from one of its edges on a cross member extending between the upper ends of vertical supports arranged at approximately right angles to the direction of wind flow, it will be blown out to a substantially horizontal position to provide a shaded area there beneath equal to the size of the panel. The sun bather then lies with his head in the shaded area and it makes no difference from which direction the wind blows relative to the sun because, so long as the sheet or panel is blown to a substantially horizontal position, a shaded area always exists beneath the panel. It is then only necessary for the sun bather to orient his body in such a position, usually in alignment in the direction from which the wind is blowing so that his face is disposed in the shaded area. When the sun is closer to the horizon, as in the late afternoon, the need for face protection is significantly reduced, the shade of the invention being particularly useful for the period of mid-morning to mid-afternoon when the direct rays of the sun are particularly strong.

Thus the broad object of the invention is to provide a sunshade for the face which is largely dependent on the wind to provide a shaded area to protect the face from the sun's rays while the rest of the body is prone and exposed to the sun.

It is another object of the invention to provide a sunshade of the foregoing nature which is easily transported, assembled and erected in its position of use.

The foregoing and other objects will become apparent as the following detailed description is read in conjunction with the accompanying drawings wherein.

Figure 1:
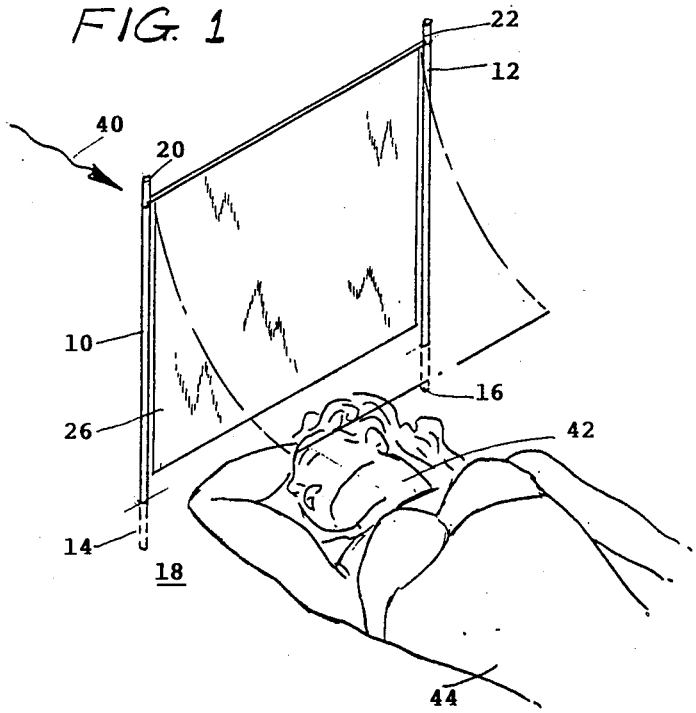
FIG. 1 is a perspective view showing the present invention erected in its position of use.
Figure 2:
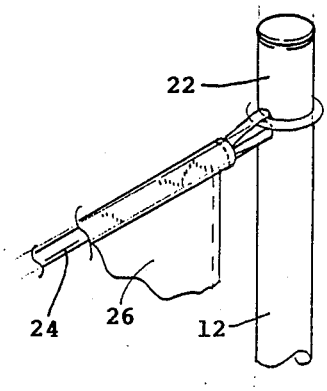
FIG. 2 is an enlarged broken perspective view showing a preferred means for connecting the cross member to the upright member.
Figure 3:
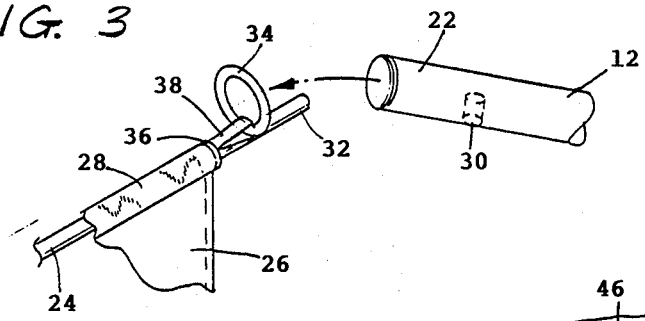
FIG. 3 is a broken perspective view showing the method of assembling the connecting means of FIG. 2.

Referring now to the drawings and particularly to FIG. 1, the sunshade of the invention comprises a pair of rigid support members 10, 12 each having a lower end 14, 16, respectively, adapted to be inserted into the ground 18 which may be a sandy beach. The support members have upper ends 20, 22 and extending between these upper ends is a cross member 24 better seen in FIGS. 2 and 3. A panel of flexible sheet material 26, preferably rectangular in shape, has an edge 28 connected to the cross member 24 whereby, in the absence of a breeze and with the support members in a vertical or substantially vertical position the sheet material 26 depends freely from the cross member 24 between the support members 10, 12.

Desirably, the cross member 24 is a substantially rigid rod, such as a wooden dowel, and means are provided for releasably interconnecting the ends of the cross member and the upper ends 20, 22 of the respective support members 10, 12. Though any of a number of releasable interconnecting means may be employed, in accordance with the invention, an opening 30, which may be a socket, is provided in one of the support and cross members to receive an end 32 in the other of the members, with means such as a ring 34 being carried by the other of the members, say the cross member 24, as shown, and being slideably receivable over the end of the one of the members, say the end 22 of the support member 12 to prevent the axial separation of the one member 24 from the opening 30 in the other of the members.

In accordance with the invention each ring 34 is carried by the cross member and is preferably attached to the outer upper edge 36 of the panel 26 by a loop 38, which may be elastic, sewn to the upper outer edge of the panel. Thus the rings serve not only to clamp the cross and upright members together but they also serve to maintain the upper edge of the panel stretched along the cross member, which is particularly desirable where the cross member is more or less loosely received in a tubular sleeve formed for that purpose along the upper edge 28 of the panel.

In use, the members 12, 24 are quickly and easily assembled by sliding the upper end 22 of the support member 12 into the ring substantially parallel to the cross member until the socket 30 is positioned over the end 32 of the cross member. The user then moves the support member towards a position at right angles to the cross member until the end 32 of the cross member axially aligns with the socket 30, whereupon the end is slid into the socket. The process is repeated at the other end it being understood that the distance between the axes of the two rings is slightly less than the distance between the axes of the support members whereby the sockets of the support members are pulled by the rings into close engagement with the ends 32 of the cross member 24 by the resilience of the connections between the rings and flexible sheet material and at the same time the panel is pulled taut over the cross member 24.

The user then inserts the lower ends 14, 16 of the support members into the ground, which can be easily done at the beach, along a line perpendicular to the direction from which the wind blows as indicated by the arrow 40 in FIG. 1. The panel 26 will be blown by the wind towards a substantially horizontal position to provide an area of shade in which the face 42 of a sun bather 44 may be positioned when the latter lies prone on the ground as shown.

Figure 4:
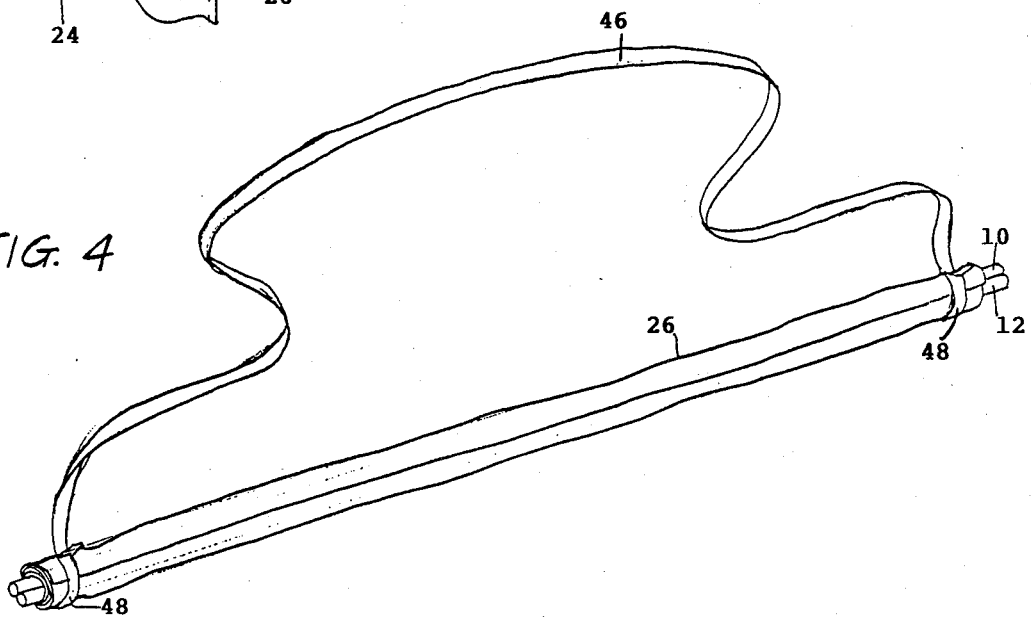
FIG. 4 is a perspective view showing the shade of the invention in its transport condition.

The members are disassembled by reverse of the action described above and for transport the two support members 10, 12, and the cross member 24 are rolled up in the flexible panel 26, as shown in FIG. 4, with a carrying strap 46 being connected to the ends of the roll by suitable slip connections 48 at the strap ends. The strap 46 preferably has a length whereby the roll may be slung from a shoulder.

It will be understood that the panel may be of any suitable material such as woven fabric or plastic sheeting. Further, it will be apparent that the invention is susceptible of a wide variety of modifications and changes without, however, departing from the scope and spirit of the appended claims.

What is claimed is:

1. A sunshade comprising a pair of rigid support members each having a lower end adapted to be inserted into the ground and an upper end, a substantially rigid cross member having opposed ends, means for releasably interconnecting the opposed ends of said cross member and the respective upper ends of said support members, a panel of flexible sunshading sheet material, and means for connecting an edge of said panel to said cross member along the length thereof such that when the latter is in its position of use connected to said support members and the lower ends thereof are inserted into the ground, said panel is freely supported by said cross member between said support members and out of engagement with any part thereof below said cross member so that when said support members with said cross member and panel connected thereto are disposed in a substantially vertical position across the path of wind said panel may be blown freely from its edge supported by said cross member towards a horizontal position to provide therebeneath an area shaded from the sun, said panel being solely supported by said cross member.

2. The sunshade of claim 1, wherein each of said interconnecting means comprises an opening in one of said support and cross members of a size to receive an end of the other of said members, and means carried by said other of said members and slidably received over the end of the one of said members for restraining against axial separation said other member from the opening in the one of said members.

3. The sunshade of claim 2, wherein the axial separation restraining means comprises a ring.

4. The sunshade of claim 3, wherein said opening comprises a socket in the upper end of said support member of a size to slidably receive an end of said cross member, and said ring is connected to said edge of said flexible material adjacent an end of said cross member.

5. The sunshade of claim 4, wherein when said cross member is connected to said support members the spacing between the axes of said rings is slightly less than the spacing between the axes of said support members so that said cross and support members are pulled together by said rings and at the same time the edge of said panel is pulled taut over said cross member.

* * * * *